US012655727B1

(12) United States Patent
Javed

(10) Patent No.: US 12,655,727 B1
(45) Date of Patent: Jun. 16, 2026

(54) BELL TYPE NON-COMPRESSIBLE TUBING END APPARATUS

(71) Applicant: SAUDI ARABIAN OIL COMPANY, Dhahran (SA)

(72) Inventor: Muhammad Imran Javed, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/038,467

(22) Filed: Jan. 27, 2025

(51) Int. Cl.
*E21B 43/10* (2006.01)

(52) U.S. Cl.
CPC ..... *E21B 43/103* (2013.01)

(58) Field of Classification Search
CPC ..... E21B 43/103
See application file for complete search history.

(56) References Cited

U.S. PATENT DOCUMENTS

| | | | | |
|---|---|---|---|---|
| 2,368,399 | A * | 1/1945 | Baker | E21B 33/1204 166/126 |
| 7,367,389 | B2 | 5/2008 | Duggan et al. | |
| 10,876,374 | B2 | 12/2020 | Mhaskar et al. | |
| 2007/0000664 | A1 | 1/2007 | Ring et al. | |
| 2007/0029082 | A1 * | 2/2007 | Giroux | E21B 33/14 166/387 |

* cited by examiner

*Primary Examiner* — D. Andrews
(74) *Attorney, Agent, or Firm* — Osha Bergman Watanabe & Burton LLP

(57) ABSTRACT

A system for use in a wellbore that includes a casing with a casing interior extending from a surface to a predetermined depth in the wellbore, a tubing with a tubing interior disposed inside the casing, and an entry guide with an entry guide upper end coupled to a tubing lower end of the tubing. The entry guide has an expandable portion that is configured to expand, in response to a pressure change, from a compressed state to an expanded state. The entry guide has an opening at an entry guide lower end that is exposed to the casing interior, and a second diameter of the opening in the expanded state is larger than a first diameter of the opening in the compressed state.

17 Claims, 4 Drawing Sheets

BELL TYPE NON-COMPRESSIBLE TUBING END APPARATUS

BACKGROUND

In the oil and gas industry, it is necessary to run through tubing intervention tools past the end of the tubing string and into the casing, such as electric wireline, slickline tools, or coiled-tubing assemblies, and other auxiliary hardware. Upon retrieving these tools, it may be difficult pulling them back into the tubing string when the tubing is open-ended. Sharp edges and square shoulders of various components may potentially cause the tools to snag or hang up upon entry. Upon completion, produced fluids may also enter an interior of production tubing through the entry guide.

An entry guide, generally having an internal bevel and a shaped opening, may be disposed at the end of the tubing. The entry guide is designed to facilitate entry of the intervention tools or other hardware into the tubing string, and also allow produced fluids to enter the interior of production tubing. Thus, there is a need for an entry guide that eliminates sharp edges and helps align the tools and fluids as they enter the tubing, as such an entry guide would minimize the chance of damage.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments a system for use in a wellbore. The system includes a casing with a casing interior extending from a surface to a predetermined depth in the wellbore, a tubing with a tubing interior disposed inside the casing, and an entry guide with an entry guide upper end coupled to a tubing lower end of the tubing. The entry guide has an expandable portion that is configured to expand, in response to a pressure change, from a compressed state to an expanded state. The entry guide has an opening at an entry guide lower end that is exposed to the casing interior, and a second diameter of the opening in the expanded state is larger than a first diameter of the opening in the compressed state.

This disclosure presents, in accordance with one or more embodiments an entry guide for use in a wellbore. The entry guide includes an entry guide upper end configured to be coupled to a tubing lower end of a tubing that is disposed inside a casing extending from a surface to a predetermined depth in the wellbore, an expandable portion that is configured to expand, in response to a pressure change, from a compressed state to an expanded state; and an opening at an entry guide lower end that is configured to expose a tubing interior of the tubing to a casing interior of the casing. A second diameter of the opening in the expanded state is larger than a first diameter of the opening in the compressed state.

This disclosure presents, in accordance with one or more embodiments a method for installing a system in a wellbore. The method includes installing a casing with a casing interior extending from a surface to a predetermined depth in the wellbore. The method includes installing a tubing with a tubing interior disposed inside the casing, and coupling an entry guide upper end of an entry guide to a tubing lower end of the tubing. The entry guide has an expandable portion that is configured to expand, in response to a pressure change, from a compressed state to an expanded state. The method includes increasing a pressure inside the tubing such that the entry guide expands from the compressed state to the expanded state. The entry guide has an opening at an entry guide lower end that is exposed to the casing interior. A second diameter of the opening in the expanded state is larger than a first diameter of the opening in the compressed state.

Other aspects and advantages of the claimed subject matter will be apparent from the following description and the appended claims.

DETAILED DESCRIPTION

Figure 1:
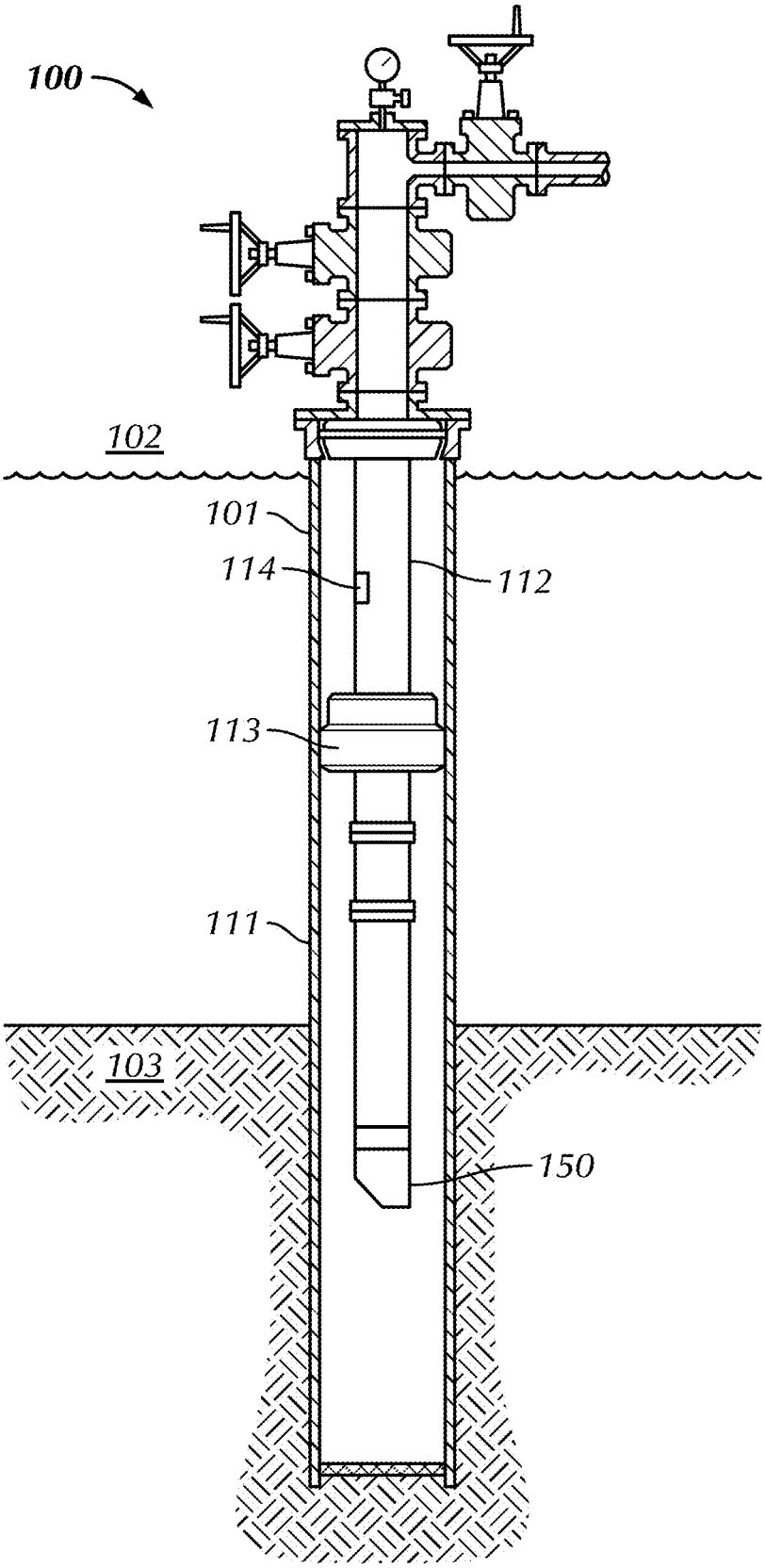
FIG. 1 shows a conventional system for use in a wellbore.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

In the present disclosure, unless otherwise defined, directional terms, such as "above," "below," "upper," "lower," etc., are used for convenience in referring to the accompanying drawings. In general, "above," "upper," "upward," "uphole," "top," and similar terms refer to a direction toward the earth's surface along a wellbore, and "below," "lower," "downward," "downhole," "bottom," and similar terms refer to a direction away from the earth's surface along the wellbore. The directional terms not only apply when different components or arrangements are vertically oriented, but also apply in deviated or horizontal wells where these directional terms are defined according to longitudinal directions of the well.

In one aspect, embodiments disclosed herein relate to systems and methods for use in a wellbore. The systems and methods disclosed herein may be used in a variety of downhole applications, for example, well intervention.

Maintaining the integrity of the wellbore system is paramount for ensuring safe and efficient hydrocarbon extraction. Wellbore integrity refers to the capability of the wellbore to contain and control the flow of fluids from the reservoir to the surface without any leaks or failures. Well intervention refers to a range of operations carried out on oil or gas wells to enhance production, manage reservoir performance, repair damaged well components, or resolve issues that impede production. These operations can include mechanical interventions, such as installing or retrieving downhole tools, and chemical interventions, such as acidizing or fracturing. Well interventions can be planned (proactive) or unplanned (reactive) and may be performed at any stage of the well's life cycle, from initial drilling and completion to production and abandonment.

In one or more embodiments, the system disclosed herein may be a system for use in a subterranean wellbore. The system may comprise a casing, which is a large-diameter tubular structure (or pipe) running from the surface to a predetermined depth in the wellbore and cemented in place to secure it and provide additional stability. The casing is generally an outermost layer in the wellbore, maintaining the structural integrity of the wellbore and preventing it from collapsing under the pressure of the surrounding formations. Intermediate and production casing layers further isolate and control the flow of fluids, ensuring that only the desired reservoir is accessed. A liner may be used and it may be hung from the downhole end of a casing string by a liner hanger. The intermediate and production casing strings are sized incrementally smaller than each other so that each consecutively smaller casing string is disposed inside the casing interior of the next larger size casing.

In one or more embodiments, the system disclosed herein may include a tubing disposed inside the casing interior diameter of the casing. For example, a tubing, having a tubing interior with a tubing interior diameter, is disposed inside the casing. For consecutively smaller casings, the tubing fits inside the interior of the last, e.g., the smallest casing installed. In general, the tubing is a tubular structure having a smaller diameter than the casing and runs inside the casing, extending from the surface (for example, a wellhead on the surface) to a predetermined depth in the reservoir. The tubing provides access for various well intervention operations, such as well stimulation, acidizing, and the installation of downhole tools, and is crucial for maintaining and enhancing well productivity over its lifecycle. The tubing provides a conduit, allowing the produced fluids (oil, gas, or water) to flow from the reservoir to the surface, and is designed to withstand high pressure and corrosive environments, ensuring the safe and efficient flow of hydrocarbons.

In one or more embodiments, the system disclosed herein may include a packer, which is a mechanical device that provides a seal between the tubing and the casing. The packer is used to isolate different zones within the wellbore, preventing the unwanted cross-flow of fluids between them, which can compromise the integrity of the well and the quality of the extracted fluids.

While not described in detail herein, one having ordinary skill in the art would recognize that the system disclosed herein may further include other structures that are commonly known in the art, such as wellhead, blowout preventor, flow control devices such as landing nipples, side pocket mandrel, various sleeves, valves, and gauges, etc.

In one or more embodiments, the system disclosed herein may include an entry guide, which is an essential component in well operations, such as in well interventions, ensuring the smooth and accurate entry of tools into the tubing. Using an entry guide for entry of tools is especially important in deviated or horizontal wells, where the trajectory can be complex. By providing a smooth entry point, the entry guide minimizes the risk of tools getting stuck or hung up at the entry point, thus reducing operational downtime. An upper end of the entry guide is usually coupled to a lower end of the tubing. The entry guide may be coupled to the tubing through threading, clamping, welding, slipping on, or any other methods that ensure a safe and tight connection. The lower end of the entry guide provides an opening that is exposed to the casing below the tubing. The entry guide may have a tapered or beveled interior near the opening, forming a funnel-like opening that smoothly transitions and a full-open internal diameter. In one or more embodiments, the entry guide is incorporated with fins or protrusions along its interior surface to further guide and stabilize the tools during entry.

Conventionally, the entry guide may have configurations such as tubular, funnel or cone, mule shoe, and half mule shoe. A mule shoe configuration has a cut-out at the opening side of the entry guide, from an edge of the opening to an opposite edge of the opening at a certain angle. A half mule shoe configuration has a cut-out at the opening side of the entry guide, from a center of the opening to an edge of the opening at a certain angle. During well operations, the entry guide may undergo severe turbulent flow conditions due to a reduction in diameter from the casing into the entry guide and the tubing. This turbulent flow causes corrosion, which leads to damage to the entry guide and introduces sharp edges. In deviated and horizontal wells, the tubing and the coupled entry guide may sit at a steep angle, so the sharp edges may potentially cause the tools to hang up upon entry. The systems and methods disclosed in one or more embodiments of the present application provide entry guides with easier and smoother entry, eliminate any sharp edges, and minimize the chance of damage.

FIG. 1 shows a conventional system 100 for use in a wellbore 101, having a half mule shoe entry guide. While a vertical wellbore is shown in FIG. 1, one would recognize that the wellbore may be deviated or horizontal. A casing 111 is cemented in place inside the wellbore 101, extending from the surface 102 downhole to a predetermined depth in into the wellbore 101. A tubing 112 is disposed inside the casing 111 and runs from the surface 102 downhole to a predetermined depth into the wellbore 101. The tubing provides a conduit for tools to be introduced downhole and for produced fluids to flow from the formation 103 to the surface 102. The tubing may be a series of tubulars threaded together and may be installed in the wellbore in a rig or rigless operation depending on the length of the tubing. A packer 113 is disposed on the outside of the tubing 112 and is used to seal the annulus between the tubing 112 and the casing 111.

A pressure inside the tubing (e.g., a tubing pressure) may be monitored by any method known in the art, for example, by using one or more pressure sensors positioned at one or more locations inside the wellbore to monitor real-time pressure inside the tubing. In one or more embodiments, pressure can be effectively monitored at the surface through the installation of one or more pressure gauges, which allows for back-calculation to the desired depth using the fluid gradient. In one or more embodiments, pressure can also be monitored by deploying one or more Permanent Down Hole Monitoring System (PDHMS) gauges in conjunction with tubing. The pressure control may be achieved at the surface using an adjustable wellhead choke. FIG. 1 shows an example of the PDHMS gauge 114 that is attached to the tubing 112 above the packer 113. The pressure gauges may alternately be disposed at other locations downhole.

The entry guide 150 is coupled to a lower end of the tubing on one end, and has an opening exposed to an interior of the casing at the other end. The entry guide 150 is configured to guide intervention tools back into the tubing 112 after completion of logging or well intervention operations in the wellbore. Conventional entry guide configurations may include tubular, funnel or cone, mule shoe, and half mule shoe. For example, the entry guide 150 shown in FIG. 1 has a half mule shoe configuration, with a cut-out at the opening side of the entry guide 150 from a center to an edge at a certain angle (for example, 45 degree). A diameter of the entry guide 150 is smaller than that of the casing 111, leaving a gap between them. The entry guide, if corroded under turbulent flow, may form sharp edges that damage the tools and cause the tools to hang up upon entry. In use, for example, the tapered/beveled entry guide lower end may help to guide a rope socket of a wireline (an eline) into tubing.

Specific embodiments showing systems and methods of the present disclosure will now be described in detail with reference to the following figures. While only a limited number of examples are shown in the figures, it is recognized to one having ordinary skill in the art that the examples are non-limiting and components described herein may be modified. Like elements in the various figures are denoted by like reference numerals for consistency.

Figure 2:
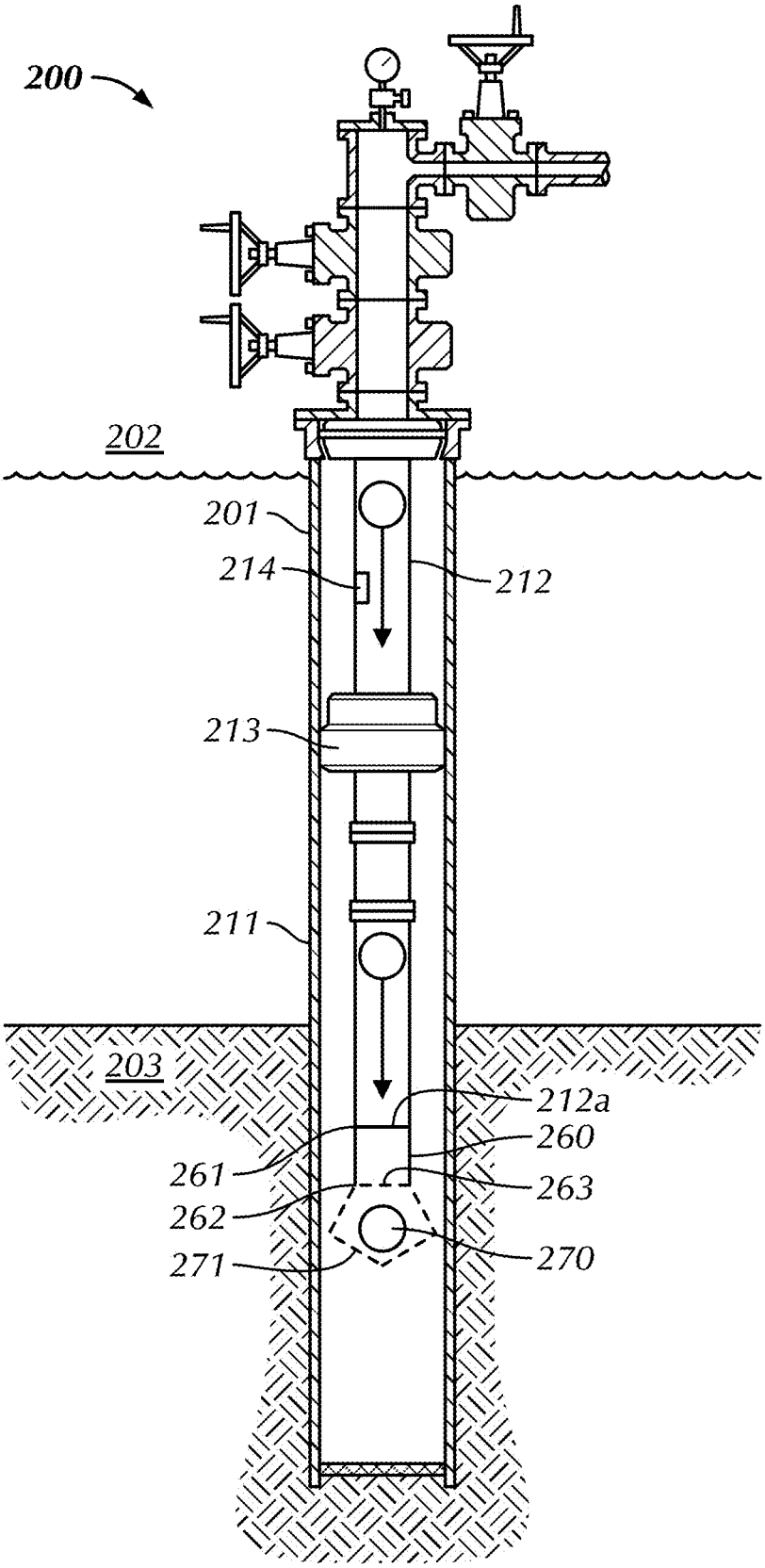
FIG. 2 shows a system for use in a wellbore in accordance with one or more embodiments of the present disclosure.
Figure 3:
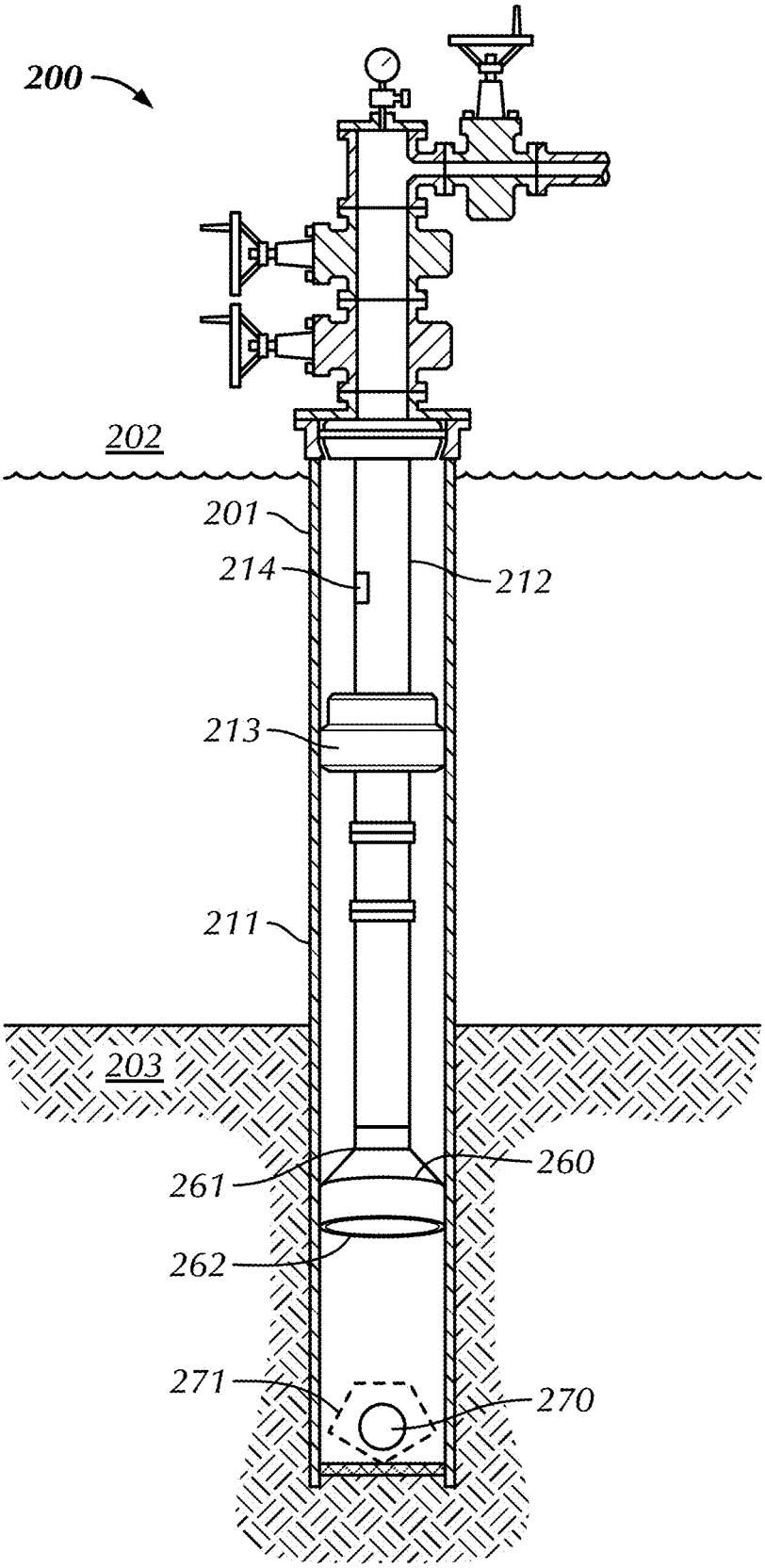
FIG. 3 shows a system for use in a wellbore in accordance with one or more embodiments of the present disclosure.

Turning to FIGS. 2 and 3, a system 200 in accordance with one or more embodiments is provided. Although vertical wellbores are depicted in these figures, it is understood by those skilled in the art that the wellbores may be deviated or horizontal, and the systems described herein may be applicable to deviated or horizontal wells.

In accordance with one or more embodiments, the system 200 includes a casing 211, cemented in place within the wellbore 201 and extending from the surface 202 downhole to a predetermined depth in the wellbore 201. The casing may include one or more different types of casing, for example, conductor casing, surface casing, intermediate casing, and production casing. The system 200 may comprise a tubing 212, disposed inside the casing 211 and running from the surface 202 downhole to a predetermined depth in the wellbore 201. The tubing 212 serves as a conduit for introducing and retrieving tools from downhole, as well as for transporting produced fluids from the formation 203 to the surface 202. The tubing 212 may comprise a series of tubulars threaded together. The tubing can be installed in the wellbore in a rig or rigless operation depending on the length of the tubing. To prevent fluid migration and ensure wellbore integrity, a packer 213 is disposed externally to the tubing 212, forming a tight seal between the tubing 212 and the casing 211 and effectively isolating specific zones within the wellbore. The packer is a critical component in well completion and intervention operations, as it enables controlled production from multiple reservoir intervals without cross-contamination or fluid loss into undesired zones. The system 200 may comprise one or more pressure sensors (not shown), such as PDHMS gauges 214, positioned at one or more locations inside the wellbore, to monitor real-time pressure inside the tubing. The pressure sensors may provide continuous measurements, enabling real-time monitoring and control of pressure inside the tubing.

In accordance with one or more embodiments, the system 200 includes an entry guide 260. The entry guide 260 has two states: a compressed state as shown in FIG. 2 and an expanded state as shown in FIG. 3. At least a portion of the entry guide 260 is an expandable portion, such that the entry guide is configured to expand from the compressed state to the expanded state in response to a pressure change. An upper end 261 (e.g., an entry guide upper end) of the entry guide is coupled to a lower end of the tubing 212*a* (e.g., a tubing lower end) through threading, clamping, welding, slipping on, or any other methods that ensure a safe and tight connection. The diameter of the upper end 261 of the entry guide may be substantially equal to the diameter of the tubing 212, in both compressed state and expanded state. A lower end 262 (e.g., an entry guide lower end) of the entry guide may have an opening with a diameter that is smaller in the compressed state and larger in the expanded state.

While the entry guide 260, in the compressed state, is shown as a cylindrical configuration in FIG. 2, it is not limited to such configuration. The entry guide 260 may have other configurations, as long as a diameter of the lower end 262 is smaller than the diameter of the tubing. A ball seat 271 is coupled to a lower end 262 of the entry guide to accommodate a ball 270 released from the surface. The ball seat 271 and the lower end 262 of the entry guide may be connected through a shearable device 263, such as a shearable disc or a shearable joint, which shears upon increased pressure. The ball seat 271 may have an opening whose diameter is smaller than the ball 270. The ball seat 271 may have a polygon shape as shown in FIG. 2, or alternatively, any other shape that accommodates the ball 270.

According to one or more embodiments, the ball 270 is released from the surface 202, travels along the tubing 212 as indicated by the arrows in FIG. 2, and settles inside the ball seat 271. The ball may travel using gravity, fluid circulation (e.g., pumping), or it may be conveyed by being pushed by a well intervention such as wireline, slickline, or coiled tubing. Pressure will be further applied through pumping to progress the ball to the seat.

In one or more embodiments, electric wireline (eline) and/or slickline (e.g., collectively, a line) with blind box or gauge cutter may follow the ball to ensure the ball reaches the depth in the well of the seat depth. For example, on some occasions, the ball does not go all the way to the bottom of the tubing and therefore does not contact the seat. Various reasons for this may include presence of a heavy fluid (high-density fluid) that holds the ball at a certain depth, or presence of some soft sludge or scale deposits, etc. In this event then the line will guide the ball to the destination point. The line or accessory connected to the end of the line (e.g., an accessory connected to an eline using a rope socket) may be specified to have a size such as a line outside diameter that is larger than the difference between the tubing inside diameter and the ball outside diameter. This practice may be used so that the line does not bypass the ball while chasing the ball all the way to the bottom or to the seat. This practice may prevent the line from tangling between the ball and tubing inside diameter.

In one or more embodiments, the ball seat 271 is close-ended, such that an interior of the tubing 212 is isolated (e.g., sealed) from an interior of the casing 211 outside the tubing. The formation of the seal (e.g., a successful cooperation of the ball and seat) may be confirmed by pressurizing the tubing 212 from inside. If a pressure inside the tubing increases upon pressurizing and remains unchanged when pressurizing ends, it indicates that the seal is properly formed and that the ball 270 is properly settled inside the ball seat 271.

Circulation of fluid may be accommodated with the use of a close-ended ball seat. Circulation of fluid does not necessarily stop with the use of a close-ended ball seat. The term close-ended ball means that none of the solid material or any equipment can go out of the tubing until the tubing end expands and forms the bell shape. Fluid circulation may be conveyed through opening ports provided at the end of seat, i.e., the bottom-most portion of tubing. Drilling or workover fluid may circulate through these ports unless or until the ball seats (i.e., until the ball is properly seated on the ball seat) thereby blocking the circulation. The blocked circulation in turn results in an increase of the pressure inside the tubing (e.g., the tubing pressure). The tubing pressure increases and reaches a pressure at which the expansion of the bell-type tubing end is completed. The tubing pressure may reach the shearing point pressure, i.e., the ball seat may shear such that the ball seat may be released. At that point, the seat and the ball may drop down to the end of tubing.

According to one or more embodiments, the entry guide 260 is composed of a material that has elasticity and plasticity, such that the entry guide is configured to expand as a result of pressure change. Because the tubing is sealed by the ball settled in the ball seat, the increased pressure leads to a pressure difference between an interior of the tubing and an interior of the casing outside the tubing. When the pressure increases to a threshold value (e.g., a first threshold pressure value or an expansion threshold pressure value), the entry guide 260 may expand from the compressed state to the expanded state in response to the pressure change. As the pressure increases to a threshold value (e.g., a second threshold value or a shearing threshold value) the shearable device connecting the entry guide 260 and the ball seat 271 may shear such that the ball seat 271 may be released. The threshold value may vary depending on a grade of the tubing used in the wellbore and may increase for heavy grade tubing. The threshold value may vary depending on a shearing value of the shearing device. The first threshold value may be the substantially the same as, greater than, or less than the second threshold value.

The expansion of the entry guide may be irreversible if, for example, the material of the expandable portion of the entry guide is configured to plastically deform. If the material plastically deforms, then once the entry guide expands to the expanded state, it cannot be compressed back to the compressed state. The material of the entry guide, e.g., the pipe, may be specified for typical downhole conditions, e.g., resistant to corrosion and compatible with the expected downhole temperatures and fluids such as completion fluids, workover fluids, and produced fluids. The pipe may be specified with a pipe wall thickness, for example, that is thinner than the production tubing wall thickness. The pipe wall thickness of the material will be less than a tubing wall thickness to promote expansion of the pipe wall versus the tubing wall. The pipe may be conceived as having characteristics in common with a sand screen, a casing patch, or a mesh-type material, albeit without any openings, holes, perforations, etc.

According to one or more embodiments, the entry guide 260 may have an enlarged opening in its expanded state, as shown in FIG. 3. In the expanded state, the diameter of the opening at the lower end 262 of the entry guide is substantially equal to an interior diameter of the casing 211 or casing liner. The diameter of the lower end opening is larger than the diameter of the upper end 261, which is substantially equal to a diameter of the tubing. Thus, the casing below the entry guide 260 is isolated from an annulus between the tubing and the casing above the entry guide.

The expanded entry guide lower end may comprise a material that forms a seal to form the isolation of the casing below the entry guide and the annulus above the entry guide. For example, the entry guide lower end may comprise a seal mechanism such as a rubber seal disposed on the outer diameter of the entry guide lower end such that in the expanded state, a rubber seal is formed between the casing interior and an exterior surface of the entry guide lower end exterior. In accordance with one or more embodiments the seal mechanism may comprise a metal-to-metal seal, a polymer seal, a composite material such as a short glass fiber reinforced (SGFR) poly-ether-ether-ketone (PEEK) material, or any combination of sealing mechanisms. The sealing mechanism may comprise a seal preparation (i.e., a seal prep) to cooperate with the sealing mechanism. For example, the entry guide may comprise an o-ring groove with an o-ring, an s-seal groove with an s-seal, a v-ring packing or other sealing mechanisms, with or without backup rings, as are known in the art.

The entry guide 260 in the expanded state may have various configurations, for example, a bell configuration, or at least a portion of the entry guide 260 has a frustoconical configuration. In the expanded state, the upper end 261 of the entry guide remains coupled to the tubing 212. Upon expansion of the entry guide 260, the ball seat 271 shears off from the entry guide and both the ball 270 and the ball seat 271 are released to the wellbore. Thus, the entry guide 260 is fully open with unrestricted access from the tubing to the casing lower than the entry guide, and there is almost no gap between the casing 211 and the entry guide 260.

One or more embodiments of the present disclosure provide an entry guide that is fully open to the wellbore and the casing, without the risk of forming sharp edges that may potentially damage or hang up intervention tools upon entry. Because no gap is present between the casing and the entry guide, there is less turbulent flow at the entry guide and thus less corrosion formed on the entry guide. Especially at highly deviated sections in the wellbore, the systems discussed herein provide safer and more flexibility techniques to retrieve intervention tools back to the tubing. Compared to conventional configurations such as mule shoe or half mule shoe, the entry guides described in one or more embodiments of the present disclosure provide a fully open access and enlarged area for intervention tools to enter.

Figure 4:
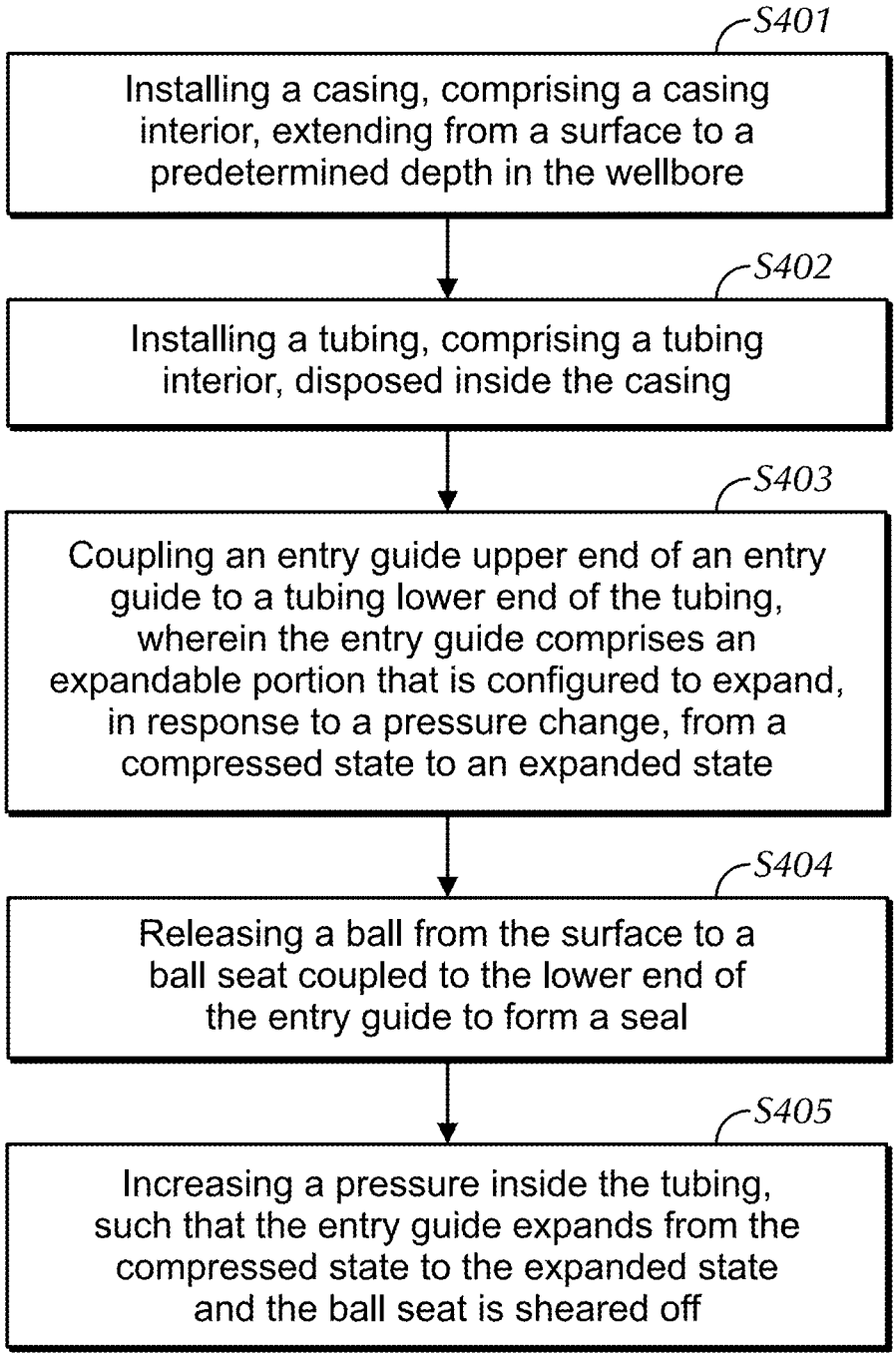
FIG. 4 shows a flowchart in accordance with one or more embodiments of the present disclosure.

FIG. 4 shows a flowchart in accordance with one or more embodiments of the present disclosure. The flowchart outlines a method for installing a system described in one or more embodiments of the present disclosure in a wellbore. One or more blocks in FIG. 4 may be performed by the systems described herein or by one or more components as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S401 and S402, a casing and a tubing are installed in a wellbore. The casing and the tubing both extend from the surface downhole to a predetermined depth in the wellbore, with the tubing disposed inside the casing. A packer may be disposed between the tubing and the casing, immobilizing the tubing and forming a tight seal between the tubing and the casing.

In S403, an entry guide is coupled to a lower end of the tubing. The entry guide is originally in a compressed state and may expand to an expanded state in response to a pressure change. Details regarding the expansion of the entry guide are discussed in other steps.

In S404, a ball is released from the surface. The ball travels through the tubing and settles at a ball seat coupled to a lower end of the entry guide. Once the ball is settled in the ball seat, a seal is formed between the ball and the ball seat, such that an interior space of the tubing is isolated from an interior of the casing outside the tubing.

In S405, the tubing is pressurized, such that a pressure inside the tubing increases. Because the tubing is sealed by the ball settled in the ball seat, the increased pressure leads to a pressure difference between an interior of the tubing and an interior of the casing outside the tubing. When the pressure reaches a threshold value, the entry guide expands from the compressed state to the expanded state in response to the pressure change. Upon expansion of the entry guide, the ball seat shears off from the entry guide and is released to the wellbore. When the entry guide is in the expanded state, a diameter of an opening at the lower end of the entry guide is larger than that of the upper end of the entry guide. The diameter of the opening at the lower end of the entry guide may be substantially equal to an interior diameter of the casing and may form a seal between the entry guide lower end and the casing interior.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system for use in a wellbore, the system comprising:

a casing, comprising a casing interior, extending from a surface to a predetermined depth in the wellbore;

a tubing, comprising a tubing interior, disposed inside the casing; and an entry guide comprising: an entry guide upper end fluidly connected to a tubing lower end of the tubing, and an expandable portion at an entry guide lower end, wherein the expandable portion that is configured to expand, in response to a pressure change, from a compressed state to an expanded state, wherein:

the expandable portion of the entry guide comprises an opening at the entry guide lower end that is exposed to the casing interior, and a second diameter of the opening in the expanded state is larger than a first diameter of the opening in the compressed state, wherein the expandable portion comprises a plastically deformable material, such that the expansion of the entry guide is irreversible after being expanded in response to the pressure change.

2. The system of claim 1, wherein no gap is present between an inner surface of the casing and an outer surface of the entry guide when the entry guide is in the expanded state.

3. The system of claim 1, wherein when the entry guide is in the expanded state, the entry guide comprises a bell shape.

4. The system of claim 1 further comprising a ball seat coupled to the entry guide lower end when the entry guide is in the compressed state, wherein the ball seat is configured to accommodate a ball released from the surface, wherein the ball seat and the ball cooperate to isolate the tubing interior from the casing interior.

5. The system of claim 4, wherein when a pressure inside the tubing increases to a threshold pressure value, the entry guide is configured to expand from the compressed state to the expanded state, and the ball seat accommodating the ball is sheared off from the entry guide.

6. The system of claim 1, wherein the second diameter of the opening in the expanded state is larger than a diameter of the entry guide upper end.

7. An entry guide for use in a wellbore, the entry guide comprising:

an entry guide upper end configured to be fluidly connected to a tubing lower end of a tubing that is disposed inside a casing extending from a surface to a predetermined depth in the wellbore; and an expandable portion at an entry guide lower end, wherein the expandable portion is configured to expand, in response to a pressure change, from a compressed state to an expanded state; and an opening of the expandable portion at the entry guide lower end that is configured to expose a tubing interior of the tubing to a casing interior of the casing, wherein a second diameter of the opening in the expanded state is larger than a first diameter of the opening in the compressed state, wherein the expandable portion comprises a plastically deformable material, such that the expansion of the entry guide is irreversible after being expanded in response to the pressure change.

8. The entry guide of claim 7, wherein the entry guide is configured to have no gap between an inner surface of the casing and an outer surface of the entry guide when the entry guide is in the expanded state.

9. The entry guide of claim 7, wherein when the entry guide is in the expanded state, the entry guide comprises a bell shape.

10. The entry guide of claim 7 further comprising a ball seat coupled to the entry guide lower end when the expandable portion of the entry guide is in the compressed state, wherein the ball seat is sheared off from the entry guide when the expandable portion of the entry guide is in the expanded state.

11. The entry guide of claim 7, wherein the second diameter of the opening in the expanded state is larger than a diameter of the entry guide upper end.

12. A method for installing a system in a wellbore, the method comprising:

installing a casing, comprising a casing interior, extending from a surface to a predetermined depth in the wellbore;

installing a tubing, comprising a tubing interior, disposed inside the casing;

coupling an entry guide upper end of an entry guide to a tubing lower end of the tubing, thereby fluidly connecting the entry guide to the tubing, wherein the entry guide comprises an expandable portion at an entry guide lower end, wherein the expandable portion is configured to expand, in response to a pressure change, from a compressed state to an expanded state; and increasing a pressure inside the tubing such that the expandable portion of the entry guide expands from the compressed state to the expanded state, wherein: the expandable portion of the entry guide comprises an opening at the entry guide lower end that is exposed to the casing interior, and a second diameter of the opening in the expanded state is larger than a first diameter of the opening in the compressed state, wherein the expandable portion comprises a plastically deformable material, such that the expansion of the entry guide is irreversible after being expanded in response to the pressure change.

13. The method of claim 12, wherein no gap is present between an inner surface of the casing and an outer surface of the entry guide when the entry guide is in the expanded state.

14. The method of claim 12, wherein when the entry guide is in the expanded state, the entry guide comprises a bell shape.

15. The method of claim 12 further comprising coupling a ball seat to the entry guide lower end when the entry guide is in the compressed state.

16. The method of claim 15 further comprising releasing a ball from the surface to the ball seat, wherein the ball seat and the ball cooperate to isolate the tubing interior from the casing interior.

17. The method of claim 16 further comprising increasing the pressure inside the tubing to a threshold pressure value, such that the entry guide expands from the compressed state to the expanded state, and the ball seat accommodating the ball is sheared off from the entry guide.

* * * * *